United States Patent [19]

Siegel

[11] 4,192,365

[45] Mar. 11, 1980

[54] ORGANIZER HANDBAG

[75] Inventor: Milton I. Siegel, Scottsdale, Ariz.

[73] Assignee: AMBA Marketing Systems, Inc., Tempe, Ariz.

[21] Appl. No.: 950,043

[22] Filed: Oct. 10, 1978

Related U.S. Application Data

[63] Continuation of Ser. No. 802,114, May 31, 1977, abandoned.

[51] Int. Cl.[2] ..... A45C 3/06; A45C 1/08

[52] U.S. Cl. ..... 150/35; 150/30; 150/39; 150/46

[58] Field of Search ..... 150/35, 34, 30, 28 R, 150/39, 42, 46

[56] References Cited

U.S. PATENT DOCUMENTS

| | | | |
|---|---|---|---|
| 1,434,926 | 11/1922 | Stember | 150/30 X |
| 1,463,729 | 7/1923 | Stember | 150/28 R |
| 1,479,591 | 1/1924 | L'Enfant | 150/30 X |
| 1,564,967 | 12/1925 | Kulick | 150/28 R |
| 1,719,040 | 7/1929 | Barol | 150/34 |
| 2,036,450 | 4/1935 | Welch | 150/42 |
| 2,439,715 | 4/1948 | Broushton | 150/39 X |
| 2,612,199 | 9/1952 | Schocket | 150/30 X |
| 2,675,042 | 4/1954 | Herrera | 150/34 |
| 2,797,461 | 7/1957 | Osher | 150/39 X |
| 3,415,300 | 12/1968 | Worcester | 150/34 X |
| 3,955,609 | 5/1976 | Siegel | 150/35 |
| 4,004,325 | 1/1977 | Hubuchek | 150/34 X |

FOREIGN PATENT DOCUMENTS

| | | | |
|---|---|---|---|
| 2351700 | 4/1975 | Fed. Rep. of Germany | 150/42 |

*Primary Examiner*—Allan N. Shoap
*Attorney, Agent, or Firm*—Gregory J. Nelson

[57] ABSTRACT

An organizer handbag having an internal compartment divided by transverse partition panels into multiple sub-compartments. Various storage components such as a removable card carrying case, pocketbook, key retainer and pouch are secured at said partitions. An external storage pouch for letters and documents is secured to one side of the handbag. Interior pockets for sundry items are also provided. In the closed position, a hinged external flap obscures the internal organizer storage components for security and to give a relatively trim and chic exterior appearance.

2 Claims, 7 Drawing Figures

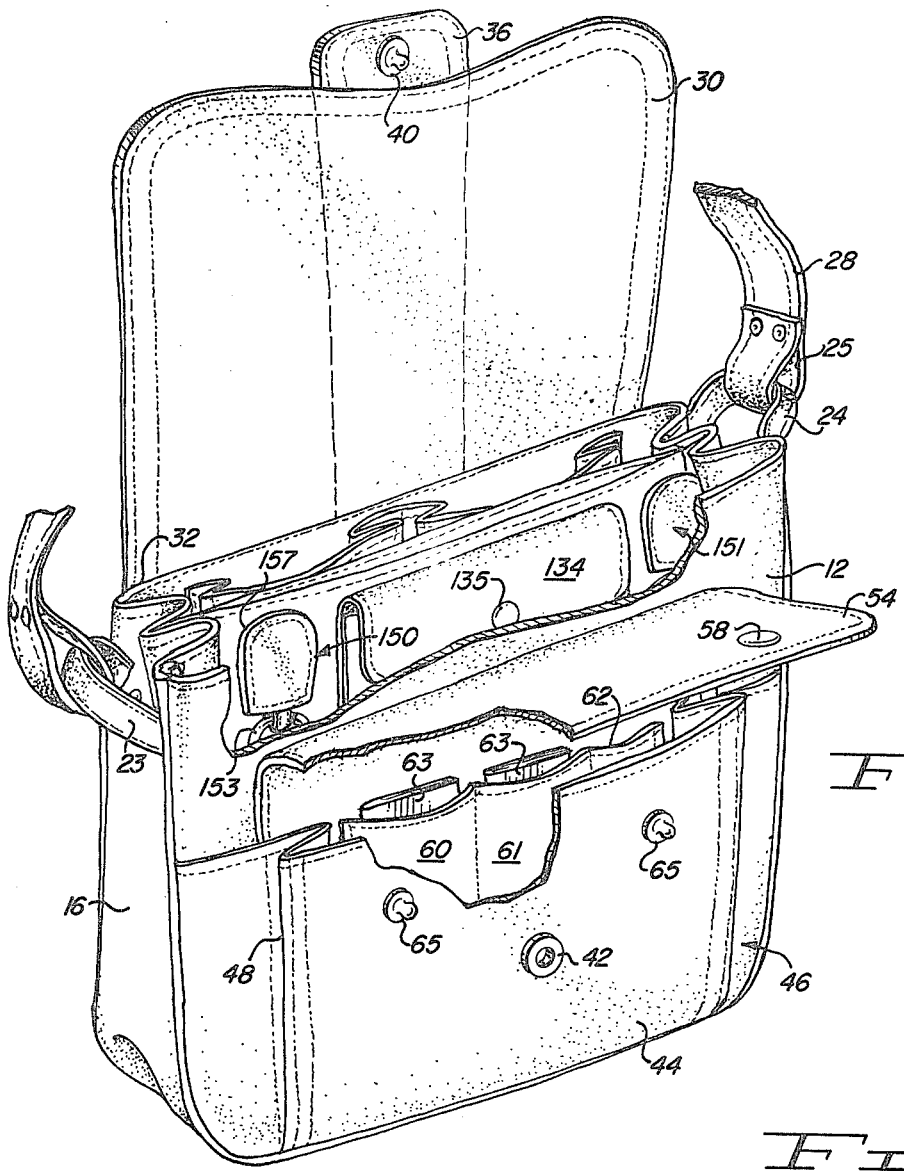
Fig. 3
Fig. 4
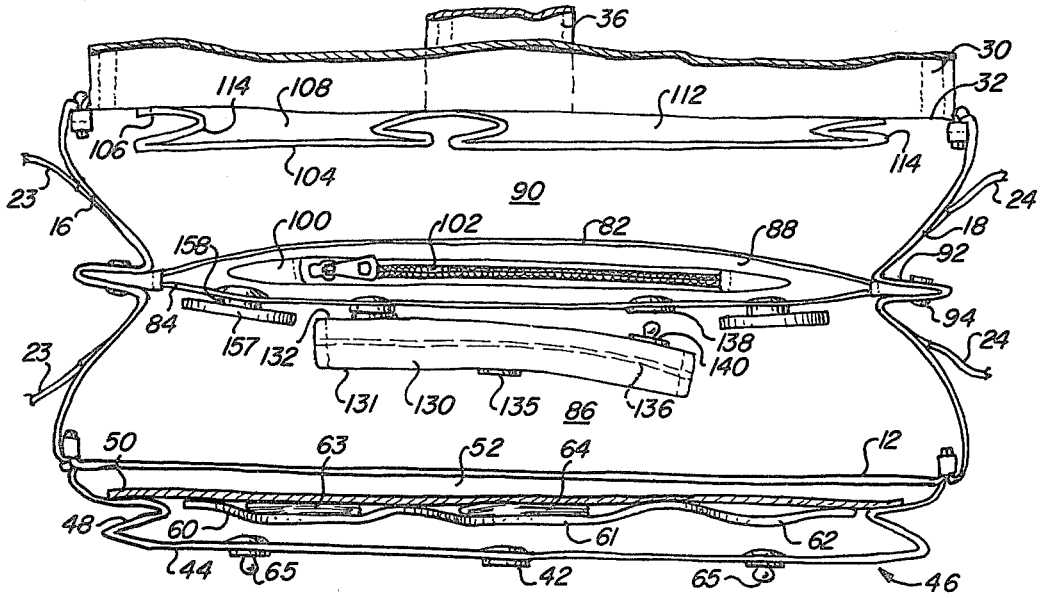

ORGANIZER HANDBAG

This is a continuation of application Ser. No. 802,114, filed May 31, 1977, now abandoned.

The present invention relates to a handbag. More particularly, the present invention relates to a compartmentalized handbag providing for the organized reception of various personal items and accessories. The sue of handbags is a well established tradition by both sexes. Some men carry handbags as a convenience item while most women consider a handbag or purse as a necessity. Most women have a number of handbags of various materials, styles and designs. The woman selects a handbag according to style and occasion and in accordance with apparel worn.

It is well known that women use their handbags as a recepticle for sundry items. Typically, a women's purse might contain credit cards, photographs, credentials, glasses, a checkbook, a wallet, change purse, keys, stamps, notepaper, phone number listings, facial tissues, and the like. To accommodate these various items, handbags of various styles, configurations and shapes can be found in the prior art. For example, U.S. Pat. No. 3,955,609 issued to the present applicant discloses a unique ladies handbag provided with oppositely opening external flaps on either side of the bag. Various compartments, both externally and internally, are provided for the convenient reception of various items. The applicant's prior patent has enjoyed wide commercial success and has found wide acceptance in the industry.

The present invention provides a handbag for the convenient reception and storage of accessory and personal items with the various pockets and compartments internally arranged in the handbag.

Accordingly, it is a principal object of the present invention to provide a ladies handbag having improved utility.

Another object of the present invention is to provide a handbag which is arranged for the organized reception and storage of assorted items of personal accessories.

Still another object of the invention is to provide a handbag for the orderly safe keeping of various items which is arranged for easy accessibility by the user.

A further obect of the present invention is to provide a handbag of the general type which is relatively inexpensive to manufacture and is aesthetically pleasing and highly utilitarian.

Briefly, to achieve the desired objectives of the present invention in accordance with the preferred embodiment, present handbag front and rear panels join along expandable edge sections to form a main compartment. The main compartment is subdivided into two sub-compartments by two intermediate panels extending between the edges of the bag. A flap is hingedly affixed to the rear panel and in a closed position overlies the exterior of the front panel. One of the sub-compartments is provided with expandable interior pockets for reception of articles such as a checkbook, folio, eyeglasses and the like. The other sub-compartment is provided with a removable pocketbook for receipt of coin and currency. Key retention means are also provided in one of the sub-compartments. The intermediate panels define a pocket for receiving a removable, zippered pouch for containment items such as, cosmetic articles. A larger pouch is carried on the outside of the front panel for receiving items such as mail and similar documents. This pouch may include several interior pockets for receipt of memos, address notebooks, pens and other writing materials. A flap is hingedly affixed to the top of the rear panel and in a closed position overlies the front panel. A retention strap is also hinged to the top of the rear panel and overlies the flap and is securable to the panel to retain the flap in a closed position. A carrying strap is attached to opposite sides of the purse.

The foregoing and further more specific objects and advantages of the present invention will become readily apparent to those skilled in the art from the following detailed description taken in conjunction with the drawings in which:

FIG. 3 is a front perspective view of the handbag with the flap in an open position;

FIG. 4 is a top view of the handbag in an open position illustrating the interior detail of the bag;

Figure 1:
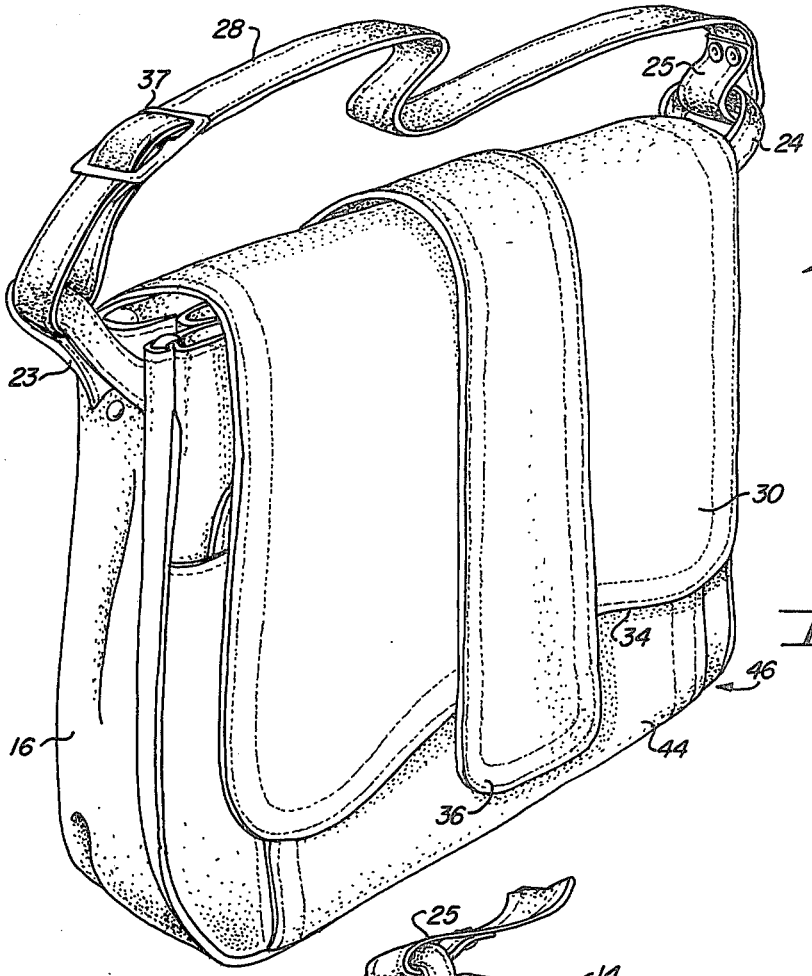
FIG. 1 is a front perspective view of the handbag of the present invention with the flap in a closed position.
Figure 2:
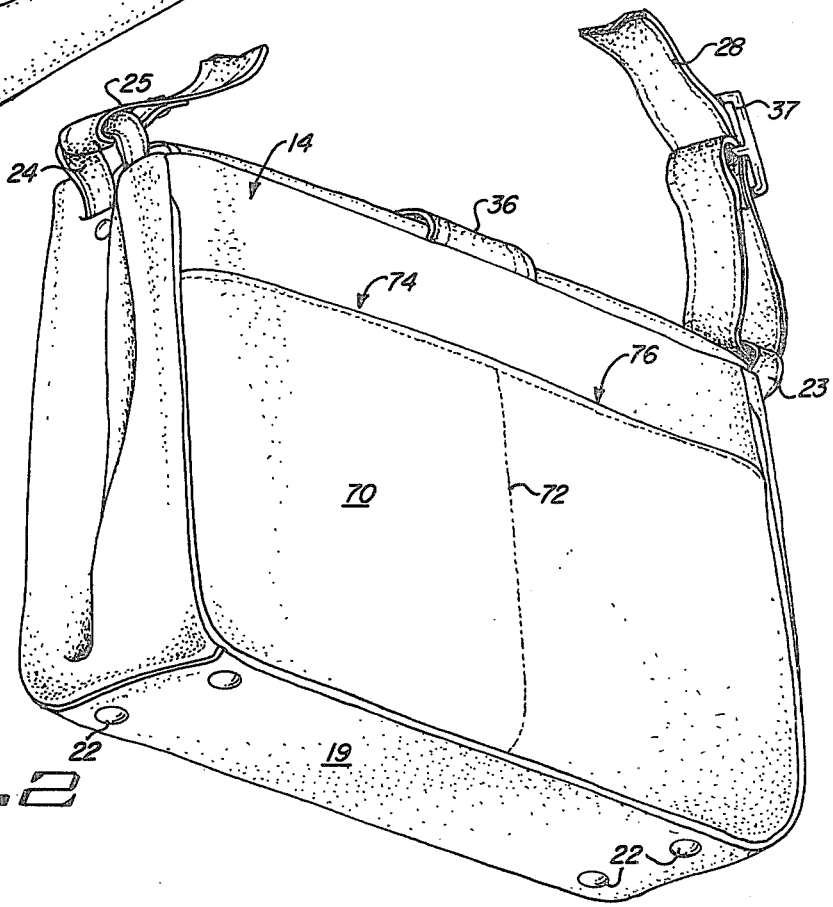
FIG. 2 is a rear perspective view of the handbag of the present invention.

Turning now to the drawings, in which the same reference numerals are used to indicate corresponding elements throughout the several views, attention is directed to FIGS. 1 through 4 which illustrate the ladies handbag constructed in accordance with the teaching of the present invention. Throughout the specification, the terms "front" and "rear" and "interior" and "exterior" are used to establish a frame of reference for description and discussion of the handbag. These terms are not to be construed in any limiting sense. Similarly, the terms "handbag", "bag" and "purse" are used interchangably throughout the specification. The handbag of the present invention is generally designated by the numeral 10 and includes a front panel 12 and a rear panel 14 joined at the vertical edges of side panels 16 and 18. Botton panel 19 is generally flat extending between the lower edges of front and rear panels 12 and 14 and side panels 16 and 18. Botton panel 19 may be reinforced by an appropriate stiffener, not shown. Buttons 22 on the underside of the botton panel 20 provide rest points for the handbag 10 and protect the bottom panel 20.

A loop 23 is secured to side panel 16 near its upper end. Similarly, a loop 24 is attached to opposite end of panel 18 near its upper end. Loops 23 and 24 may be secured by any conventional means such as by a rivet or heat seal methods. A carrying strap 28 extends between the loops 23 and 24. One end of strap 28 is attached to loop 24 by forming a loop 25 at the end of strap 28 and engaging loop 24 with 25. The opposite end of strap 28 is doubled back through loop 23 and the looped end of 28 is engaged in buckle 37. The use of buckle 37 provides adjustability of the length of strap 28. As will be immediately apparent to those skilled in the art, handbag 10 may be fabricated from various suitable materials such as leather or vinyl and is either sewn, heat bonded or otherwise assembled or fabricated in accordance with established techniques of the art.

A closure flap 30 is hingedly affixed to the upper edge of rear panel 14 at upper edge 32. Flap 30, in the closed position as illustrated in FIG. 1, lies in juxtaposition when closed covering a substantial portion of front panel 12 and pouch 46. The lower edge 34 of flap 30 may be scalloped or contoured as shown to present an aesthetically pleasing appearance. An elongated retention tab 36 is hingedly affixed to the upper edge 32 of panel 14 at a central position. Tab 36 overlies flap 30 and in the closed position extends to a position below the edge 34 of flap 30. A snap fastener half 40 is carried on the inner side of retention tab 40. Cooperative snap fastener half 42 is secured to pouch panel 44.

A generally rectangular pouch 46 useful for carrying letters, receipts, and corresponding similar documents is carried on the front of front panel 12. Pouch 46 is formed by front panel 44 secured by the vertical edges of front panel 12 by pleated, expandable end members 48. Rear panel 50 is stitched or otherwise affixed at opposite edges to pleated end members 48 so that an insert pocket 52 is defined between front panel 12 and panel 50. Flap 54 is an extension of panel 50 and forms a closure member for pouch 46 and carries a pair of female fastener members 58 which matingly engage male snap fastener members 65 carried at the upper edge of pouch panel 44. Pocket 52 can be used for storage of letters, documents, coupons and similar items. Note that when the handbag is in the closed position with closure flap 30 overlying the front panel and retention tab 36 engages at fastener members 40 and 42, pouch 46 and pocket 52 are secure and concealed from view. In the closed position, flap 30 serves to prevent items from being inadvertently dislodged from pocket 52.

Pockets 60 and 61 are provided within pouch 46 for reception of notebooks or address books 63. A smaller pocket 62 is adjacent pocket 61 for insertion of a pen, pencil or other writing instrument.

A generally rectangular panel 70 is secured along the side edges and bottom to the exterior of the rear panel 14. In accordance with the preferred embodiment of present invention, adjacent pockets 74 and 76 are formed between panel 14 and panel 70 by medial stitch line 72. Pockets 74 and 76 provide compartments for carrying various accessories and items such as tissues, handkerchiefs and scarves. Since pockets 74 and 76 are exposed, they are designed primarily to accommodate items which would not be of substantial value and be the subject of theft.

Partition panels 82 and 84 extend transversely between the sides 16 and 18 of the bag forming three sub-compartments, front sub-compartment 86, intermediate sub-compartment 88 and rear sub-compartment 90. Partition panels 82 and 84 are are secured at a gather or pleat 92 in each end wall by suitable fastening means such as rivet 94. Compartment 88 is configured to receive removable pouch 100. Pouch 100 is provided with a zipper closure 102 and provides a convenient storage for cosmetic and makeup items carried by women. Pouch 100 can be removed from compartment 88 when cosmetic items are required.

Figure 7:
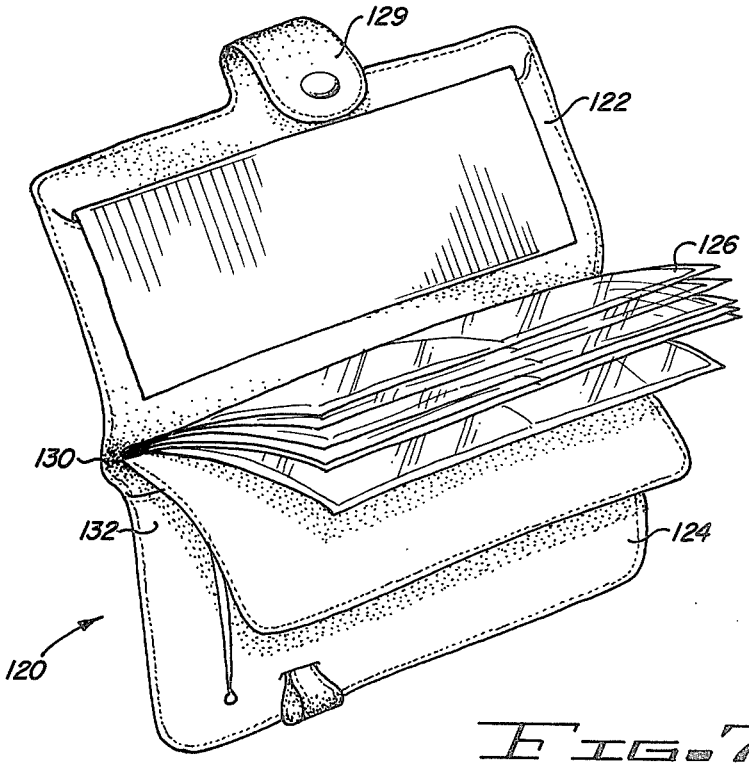
FIG. 7 is a perspective view illustrating the card carrying case which is receivable within the handbag.

Storage means in the form of a pair of adjacent pockets 108 and 112 are formed in compartment 90 at the interior side of panel 14 by panel 104. Panel 104 is stitched to panel 14 at the vertical stitch lines 106. Panel 104 is pleated at accordian folds 114 to provide expandability of the pocket. Pocket 108 is sized and configured to accommodate such items as eyeglasses. Pocket 112 is sized and configured to accommodate a folio such as folio 120, as shown in FIG. 7. Folio 120 has a front and rear cover 122 and 124, respectively, joined along medial fold line 130. Folio 120 contains a series of pages of leaves 126 each defining one or more pockets for receiving credit cards, photos and other items. These leaves are, for example, of the type more fully described in U.S. Pat. No. 3,759,305, entitled "Card Carrying Case", issued to Donald E. McIntyre. A closure tab 129 with snap fastening means secure front and rear panels 122 and 124 in a closed position. The inner side of front panel 122 may be provided with a pocket 132 for insertion of a conventional checkbook.

Figure 5:
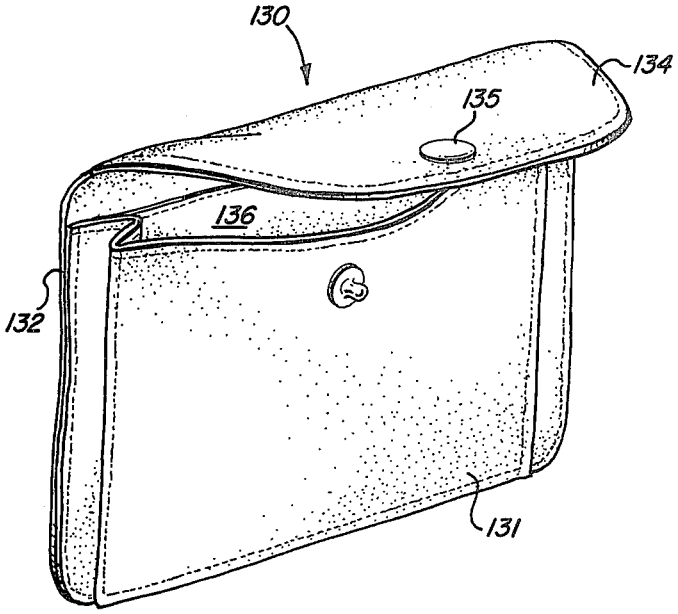
FIG. 5 is a front perspective view of the pocket book which is cooperably received within the handbag of the present invention.
Figure 6:
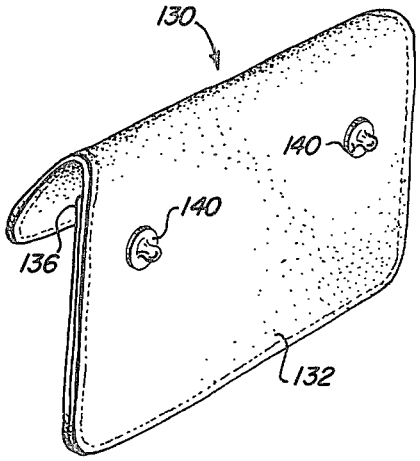
FIG. 6 is a rear perspective view of the pocketbook shown in FIG. 5.

A removable purse 130 as shown in detail in FIGS. 5 and 6, is detachably secured to the side of partition 84 disposed towards sub-compartment 86. Purse 130 is primarily for receipt of coins and currency and has front and back panels 131 and 132, respectively. A closure flap 134, which is an extension of rear panel 132, is adapted to overlie a portion of front panel 131 in a closed position and be engaged at fastener 135. A pair of male snap members 140 are secured to the rear panel 132 of the purse. Mating, fastener members 140 are secured to panel 84. A divider panel 136 extends transversely between the edges of panels 132 and 136 subdividing pouch 130 into two interior pockets. Thus, pocketbook 130 can be engaged within pocket 86 and currency and coins removed and inserted in this position. Also, it is convenient for the user to disengage pocketbook 130 at snap members 138 and 140 and transfer the pocketbook to another pulse. Further, the detachability of the pocketbook provides security as money may be removed from the purse for safekeeping in the event the entire handbag is stored or left unattended.

Key retainer members 150 and 151 are disposed at either side of pocketbook 130. Since the key retainers 150 and 151 are identical, detailed description of one of the retainers is sufficient. Retainer 150 includes a body 157 and snap half 158. Keyholder means 153 is in the form of a coiled loop and is well known in the art. Mating snap half members 158 are secured on panel 84. With key retainers 150 and 151 engaged to panel 84, the keys on each retainer are readably available and are stored within the security of sub-compartment 86. Keys may be retreived for use without necessity of rummaging through the bottom of the purse as is normally necessary when keys are carried as loose items in the pocket of a purse. Including the multiple key retainers permits the user to maintain, for example, automobile and residence keys on separate retainers. Therefore, it is not necessary for the user to manually separate, for example, an automobile key when use of the car is loaned to another individual.

Preferably, the pockets, such as pockets 86, 88 and 90 are provided with an interior lining of suitable material as is conventional in the art.

Therefore, from the foregoing it will be seen that the present invention provides a unique and novel handbag which provides convenient compartments for the organized storage of all types of parphenalia and accessories handbag users require. Pockets are provided for the organized reception of credit cards, photographs, glasses, checkbooks, tissues, stamps, papers, phone number listings and the like. Further, the handbag in the present invention provides for the attachment retention of keys within a secure department in the handbag. Removable pouches or pocketbooks are provided for accessory items such as cosmetics, currency and coins. In the closed position, most of the organizer features of the handbag are obscured so that the appearance in the closed position is pleasing and stylish. The specialized facilities for successful storage of personal items in a closed position also provides security so that these items are not easily detected by potential thieves.

Various changes and modifications to the embodiment herein chosen for the purpose of illustration will incur no skill in the art. To the extent that these changes or modifications do not depart from the spirit and scope of the appended claim, they are adapted to be included therein.

Having fully described and disclosed the present invention and preferred embodiment in clear and precise terms, to enable those skilled in the art to understand practice of the same, I claim:

1. An organizer handbag for the orderly and accessible reception of personal convenience items comprising:

(a) a body having a bottom panel, a front panel and a rear panel having upper horizontal edges and side and bottom edges, said side edges being joined to an expandable end wall member on each side of said front and rear panels, the bottom edges and end wall members being joined to said bottom to form a main compartment;

(b) at least two transverse panels extending between and secured to each respective end wall member sub-dividing the main compartment into at least three subcompartments comprising:

(i) a front subcompartment formed between one of said transverse panels and said front panel;

(ii) an intermediate subcompartment adapted to secure a removable pouch at a position wherein an edge of said pouch is substantially co-extensive with the top of said main compartment; and (iii) a rear compartment formed between one of said transverse panels and said front panel;

(c) pocketbook means detachably secured to one of said panels at one of said subcompartments near the upper edge thereof whereby the pocketbook is readily accessible through the said subcompartment and whereby the pocketbook may be easily attached or detached when the handbag is in an open position;

(d) storage compartment means located within at least one of said subcompartments, said storage compartment means being adapted to receive a card carrying case for selective display of documents;

(e) an exterior pouch panel extending generally transversely across the front of said front panel and extending vertically from the bottom to a location below the upper horizontal edge of said front panel and being joined thereto at opposite vertical edges and along the bottom edge, an insert panel extending intermediate said pouch panel and said front panel forming an insert pocket between said front panel and said insert panel and an exterior pouch between said insert panel and said pouch panel, said insert panel having a vertical extension forming a flap moveable to a closed position overlying said pouch panel, said pouch further including interior pocket means adapted for reception of writing materials; and (f) a flap hingedly affixed to the said rear panel substantially near the upper horizontal edge and moveable to a closed position over-lying said front panel and having an open position permitting free access to said interior subcompartments, said flap in said closed position obscuring the contents of said subcompartments and simultaneously covering said exterior pouch and insert pocket for added security;

(g) the bottom panel being generally flat and generally defining the total bottom perimeter of the handbag.

2. The handbag of claim 1 further including a tab detachably secured at one of said transverse panels, said tab including means for securing keys thereto.

* * * * *